US010242796B2

(12) United States Patent
Kitamura

(10) Patent No.: US 10,242,796 B2
(45) Date of Patent: Mar. 26, 2019

(54) METHOD FOR MANUFACTURING A SURFACE-MOUNT INDUCTOR

(71) Applicant: TOKO, INC., Tsurugashima-shi, Saitama-ken (JP)

(72) Inventor: Kazuhisa Kitamura, Tsurugashima (JP)

(73) Assignee: Murata Manufacturing Co., Ltd., Nagaokakyo-shi, Kyoto (JP)

( * ) Notice: Subject to any disclaimer, the term of this patent is extended or adjusted under 35 U.S.C. 154(b) by 197 days.

(21) Appl. No.: 15/434,103

(22) Filed: Feb. 16, 2017

(65) Prior Publication Data

US 2017/0162321 A1 Jun. 8, 2017

Related U.S. Application Data

(62) Division of application No. 14/979,636, filed on Dec. 28, 2015, now Pat. No. 9,613,744.

(30) Foreign Application Priority Data

Dec. 26, 2014 (JP) ..... 2014-264165
Dec. 26, 2014 (JP) ..... 2014-264166

(51) Int. Cl.
*H01F 41/064* (2016.01)
*H01F 27/29* (2006.01)
(Continued)

(52) U.S. Cl.
CPC ..... *H01F 41/064* (2016.01); *H01F 17/043* (2013.01); *H01F 27/2852* (2013.01);
(Continued)

(58) Field of Classification Search
CPC .. H01F 17/043; H01F 27/292; H01F 27/2852; H01F 27/306; H01F 41/064; H01F 41/063
See application file for complete search history.

(56) References Cited

FOREIGN PATENT DOCUMENTS

CN 101622681 A 1/2010
CN 103151139 A 6/2013
(Continued)

OTHER PUBLICATIONS

Chinese Office Action with English Translation (Chinese Application No. 201510994106.2) (12 pages—dated Jun. 25, 2018).

*Primary Examiner* — Carl Arbes
(74) *Attorney, Agent, or Firm* — Renner, Kenner, Greive, Bobak, Taylor & Weber

(57) ABSTRACT

A surface-mount inductor including a coil formed by winding a rectangular wire and a molded body for accommodating the coil, where the coil includes: a first roll formed by winding a rectangular wire, a second roll formed by winding the rectangular wire in position adjacent to the first roll along the winding axis, and a third roll formed by winding the rectangular wire on the second roll in a partially overlapping manner in a position adjacent to and opposite from the first roll along the winding axis, the ends of the wire being brought out from the outermost turns of the first roll and the third roll as lead ends, and the winding axis is parallel with the mounting face and the lead ends being extended over the surface of the molded body, as well as the method for manufacturing the same.

3 Claims, 11 Drawing Sheets

(51) Int. Cl.

| | |
|---|---|
| ***H01F 17/04*** | (2006.01) |
| ***H01F 27/28*** | (2006.01) |
| ***H01F 27/30*** | (2006.01) |
| ***H01F 41/063*** | (2016.01) |
| ***H01F 41/098*** | (2016.01) |

(52) U.S. Cl.
CPC ..... *H01F 27/292* (2013.01); *H01F 27/306* (2013.01); *H01F 41/063* (2016.01); *H01F 41/098* (2016.01)

(56) References Cited

FOREIGN PATENT DOCUMENTS

| | | | | |
|---|---|---|---|---|
| CN | 103339695 | A | | 10/2013 |
| DE | 10248392 | A1 | * | 5/2004 |
| EP | 2 521 146 | A2 | | 11/2012 |

* cited by examiner

METHOD FOR MANUFACTURING A SURFACE-MOUNT INDUCTOR

CROSS-REFERENCE TO RELATED APPLICATIONS

This application is a division of U.S. patent application Ser. No. 14/979,636 filed on Dec. 28, 2015, which is incorporated herein by reference, and claims the benefit of priority from the prior Japanese Patent Application No. 2014-264165, filed on Dec. 26, 2014, and Japanese Patent Application No. 2014-264166, filed on Dec. 26, 2014, the entire contents of which are incorporated herein by reference.

BACKGROUND OF THE INVENTION

1. Field of the Invention

The present invention relates to a surface-mount inductor and a method for manufacturing the same.

2. Description of the Related Art

Conventionally, surface-mount inductors which coil has been coated with thermoplastic sealants (molding materials) containing magnetic powder and resin are widely used. For example, JP2003-290992 discloses a method for manufacturing surface-mount inductors using metal pieces as external terminals. The surface-mount inductors have external terminals which are metal pieces welded to lead ends which are processed to serve as external terminals.

JP2004-193215 discloses a method for manufacturing surface-mount inductors by coating coils, which is configured by winding a wire having a rectangular section (hereinafter "rectangular wire"), with sealing material. The surface-mount inductor has external terminals which are formed by deforming lead wires of a coil.

SUMMARY OF THE INVENTION

In a surface-mount inductor disclosed in JP2003-290992, since its coil ends are welded to metal pieces, the contact portions of the coil ends and of the metal pieces are exposed to thermal and mechanical stresses.

In the surface-mount inductor of JP2004-193215, since the direction of the winding axis of the coil is orthogonal to the wide surface of the rectangular wire, the inner and outer diameters are exposed to mechanical stress during winding.

Further, the surface-mount inductor in JP 2004-193215 is configured so that one lead end goes from its bottom side to the bottom and the other lead end goes from upper side to the bottom.

In this case, because of the difference in the length of the lead wires, the shape of the coil is asymmetrical. The surface-mount inductor housing an asymmetrical coil requires a step of marking the polarity of the terminals, since the electric characteristics when inputting in one terminal are different from those when inputting in the other terminal.

Consequently, the present invention aims to provide a surface-mount inductor has less mechanical and thermal stresses, and provides a method for manufacturing of the same.

Means for Solving the Problem

A surface-mount inductor according to the present invention is characterized by including a coil formed by winding a rectangular wire and a molded body for accommodating the coil, wherein the coil comprises:

a first roll formed by winding a rectangular wire, a second roll formed by winding the rectangular wire in position adjacent to the first roll along the winding axis, and a third roll formed by winding the rectangular wire on the second roll in partially overlapped manner in position adjacent and opposite to the first roll along the winding axis, wherein the ends of the wire are brought out from the outermost turns of the first roll and the third roll as lead ends, and the winding axis is parallel with the mounting face and the lead ends extend over the surface of the molded body.

A method for manufacturing a surface-mount inductor according to the present invention is characterized in that the inductor includes a coil formed by winding a rectangular wire and a molded body for accommodating the coil, wherein a step for making a coil, forming a first roll contacting the median portion of a rectangular wire to the spindle of a winding machine to wind, forming a second winding portion at a position adjacent to the first roll along the winding axis, arranging a jig at the first roll side of the second roll, forming a third roll winding the wire on the second roll at a position opposite to the first roll along the winding axis in such a manner that a portion of the third roll partially overlap with the second roll, and forming lead ends brought out from the outermost turn of the first roll and the third roll; and a step for housing the coil inside the molded body, whereby the coil is housed in the molded body, arranging the winding axis be parallel with the mounting face of the molded body, and the lead ends extending over the surface of the molded body.

Effect of the Invention

According to the surface-mount inductor and the manufacturing method of the same as described in the present application, since the lead ends of coil are used as external terminals, the thermal and mechanical stresses are decreased. Further, since the direction of the winding axis and that of the wide surface of the coil are parallel, the mechanical stress caused at the inner and outer diameter portions may be decreased. In addition, since the coil is wound such that the direction of the mounting face of the surface-mount inductor and the direction of winding axis of the coil are parallel, the shape of the coil may be symmetrical.

Therefore, a surface-mount inductor, which serves to decrease the thermal and mechanical stresses, and to solve the issue of polarities of electrical characteristics polarity, as well as a method for manufacturing the same can be provided.

DETAILED DESCRIPTION OF THE INVENTION

Embodiment 1

The first embodiment of a surface-mount inductor according to the present invention will now be described with reference to FIGS. 1 through 7.

Figure 1:
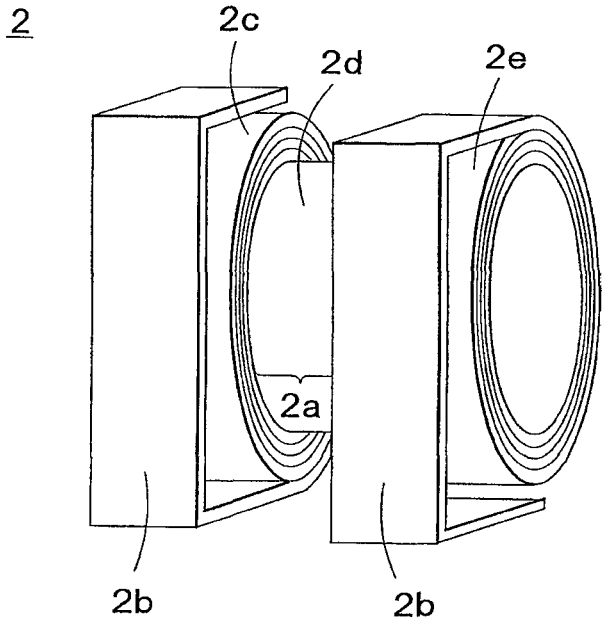
FIG. 1 is a perspective view of a surface-mount inductor of the first embodiment according to the present invention.

FIG. 1 is a perspective view showing an example of a coil 2 used in the surface-mount inductor according to the present invention, the coil 2 being formed by winding a rectangular wire contacting the wide surface 2*a* on a winding core (not shown), and processing the ends of the wire to be lead ends 2*b*.

As shown in FIG. 1, a coil 2 is a coreless (empty core) coil having symmetrical profile when viewed from a direction orthogonal to the axial line. The coil 2 has a first roll 2*c*, which is such configured that one end of a rectangular wire is positioned at the outermost turn and the other end of a rectangular wire at the innermost turn is positioned adjacently along the winding axis, and a second roll 2*d*, which is configured as one roll, is positioned adjacent to the first roll 2*c* on opposite side along the winding axis of the coil 2, and a third roll 2*e*, which is configured as one roll, the inner diameter of which is equal to or larger than the outer diameter of the second roll 2*d*, and the third roll 2*e* is wound on the second roll 2*d* in partially overlapping manner at a position adjacent to the second roll 2*d* and opposite side to the first roll 2*c* along the winding axis of the coil 2.

From the outermost turn of the third roll 2*e*, the lead ends 2*b*, which are the ends of the rectangular wire, are brought to the extending direction of the outer peripheries. The respective lead ends 2*b* are brought toward opposite directions from the winding axis and the end portions are formed to be U-shaped to shelter the outermost turn of the coil 2.

The coil 2 thus formed does not suffer from mechanical stress around the inner and outer diameter portions when winding, because the direction of the wide surface 2*a* and the direction of the rectangular wire are parallel.

A method of winding the coil 2 is described in reference to FIGS. 2A through 2F. The coil 2 is formed by winding an insulated rectangular wire using a winding machine (not shown) equipped with a pair of spindles 3. Each spindle 3 has a winding core 3*a* and a base portion 3*b*, and is equipped with a jig 3*c* having a C-shaped mouth at the tip.

A pair of spindles 3 includes a pair of winding cores 3*a*, a pair of cylindrical base portions 3*b* which are adjacent and coaxial to the winding cores 3*a* and have a diameter larger than that of the winding cores 3*a*. The length of the winding core in the axial direction is larger than the width of the rectangular wire. The spindle tips 3*aa* are the end faces of the winding cores 3*a* and are positioned at sides opposite to the base portions 3*b*.

Figure 2A:
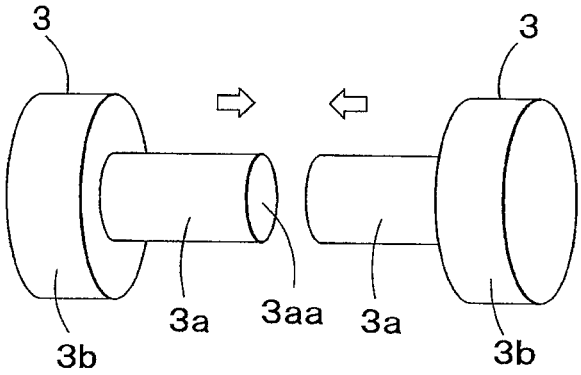
FIGS. 2A through 2F show steps in method of winding a coil which is used in the surface-mount inductor of the first embodiment according to the present invention in sequential manner.

Firstly, the two spindles 3 are positioned in a manner that the spindle tips 3*aa* face each other, as shown in FIG. 2A.

Figure 2B:
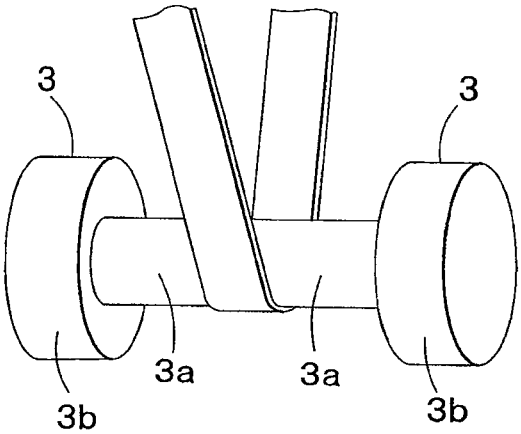
Figure 2C:
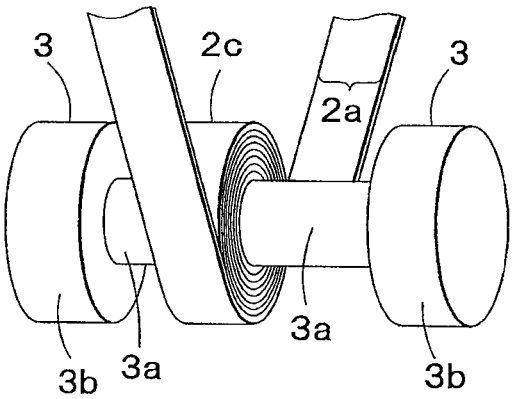
Figure 2D:
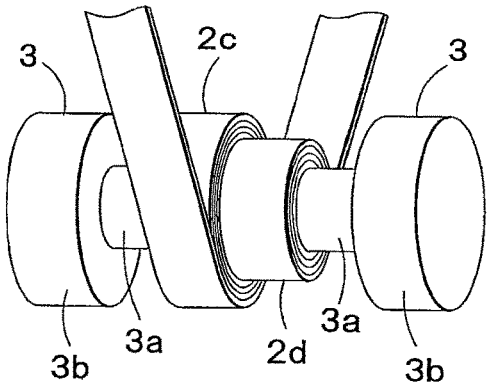

Next, as shown in FIG. 2B, the wide surface 2*a* of the median portion of the rectangular wire is put in contact with the winding cores 3*a*. Then, as shown in FIG. 2C, the ends of the rectangular wire are repetitively wound around the winding cores 3*a*, and the first roll 2*c* is formed on the winding cores 3*a*. And then, one end of the rectangular wire at the innermost turn of the first roll 2*c* is shifted in the opposite direction from the first roll 2*c* along the winding axes of the spindles 3 to be in contact with the winding cores 3*a*. And, as shown in FIG. 2D, the rectangular wire is wound on the winding cores 3*a* to form the second roll 2*d*.

Figure 2E:
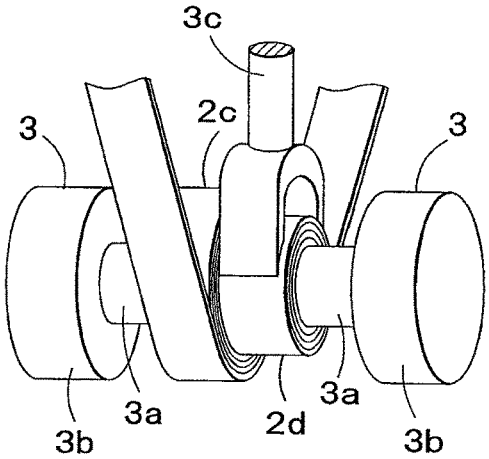

Subsequently, as shown in FIG. 2E, a jig 3 having a C-shaped mouth is arranged on the second roll 2*d* to be in contact with the end of the first roll 2*c*. In this state, the third roll 2*e* is formed by winding a rectangular wire on the second roll 2*d* in partially overlapping manner at a position opposite to the first roll 2*c* in the direction of the winding axis.

Figure 2F:
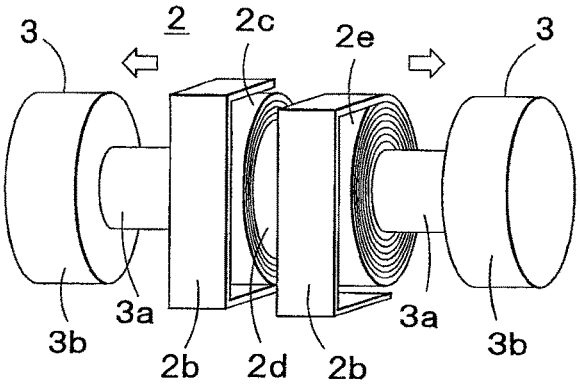

The lead ends 2*b* are pulled from the outermost turn of the coil 2 in its extended directions oppositely each other and the ends are bent to form U-shaped portions. The coil 2 is heated and solidified, and then is removed thereafter from the spindles 3 as shown in FIG. 2F, thus producing the coil 2 which is symmetrical relative to a direction orthogonal to the winding axis.

The lead ends 2*b*, which are the ends of the rectangular wire, are brought out in the extending direction thereof from the outermost turns of the first roll 2*c* and of the third roll 2*e*, respectively. The lead ends 2*b* are brought out in opposite directions to each other from the winding axis and the ends are bent in a U shape to surround the outer periphery of the coil 2. The coil 2 is left by heating it and, as shown in FIG. 2F, distancing the spindles 3, which tips are in mutual contact, from the coil 2.

Although the coil 2 is formed by winding, in sequence, the first roll 2*c*—the second roll 2*d*—the third roll 2*e*, the sequence may be varied. A sequence of the second roll 2*d*—the third roll 2*e*—the first roll 2*c* may be employed, and a sequence of the first roll 2*c* to halfway, the second roll 2*d* and the first roll 2*c* to the end and then the third roll 2*e*, etc., can also be applicable, with the sequences being unlimited.

The shape of the mouth of the jig 3*c* is not limited to a C shape, other shapes which prevent winding of a rectangular wire at the point of contact of the jig are also applicable.

Further, by varying the thickness of the jig 3*c*, the width of the second roll 2*d*, namely the distance between the first roll 2*c* and the third roll 2*e*, may be varied, thus the axial length of the coil 2 may be varied. Toward such a purpose, a plurality of jig of the same shape and a certain thickness may be employed.

For example, in the case the thickness of the second roll 2*d* is superposed 3 mm, three jigs of 1 mm thickness may be used to easily adjust without changing the manufacturing process. The jigs may be shaped to engage with each other so as to be easily superposable and less slippery.

A molded body 4 which includes the coil 2 will be described in reference to FIG. 3. The molded body 4 is formed by assembling two blocks 4*a*. The block 4*a* is formed by applying pressure to a sealant consisting of a filler with metallic magnetic powder and epoxy resin.

Figure 3:
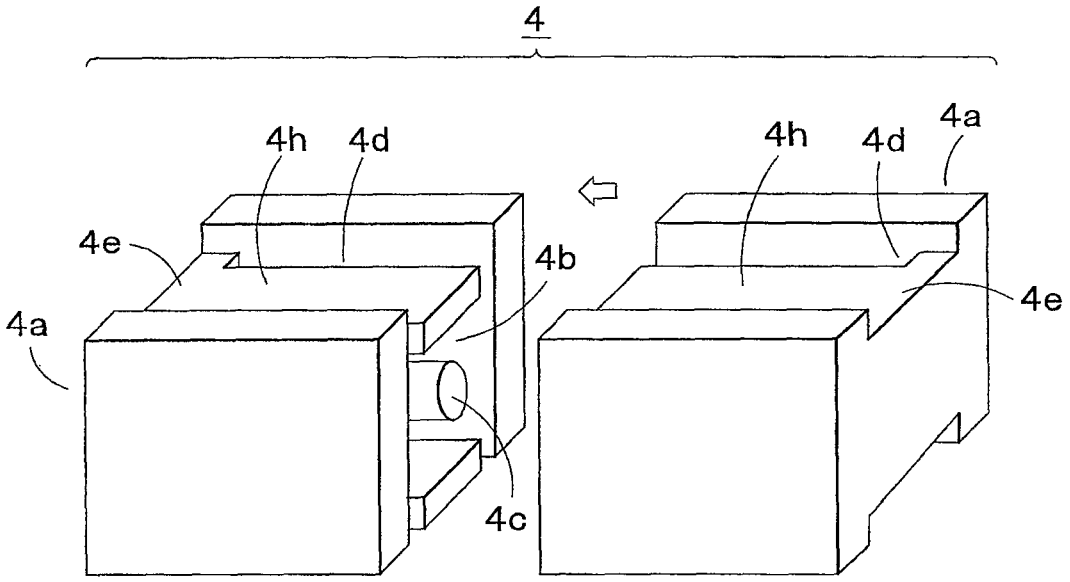
FIG. 3 is a perspective view of the blocks which are used in the first embodiment according to the present invention.

As shown in FIG. 3, the blocks 4*a* are rectangular parallelepipeds having one open end surface and a space 4*b* to accommodate the coil 2 inside. The cylindrical protrusion 4*c* to pass through the winding axis of the coil 2 extends from the central portion of the inner wall of the end surface opposing the open end surface. The upper and bottom surfaces of the block 4*a* have the same shape, with one of them serving as the mounting face 4*e*. In the case shown in FIG. 3, the upper surface is the mounting face 4*e*.

Figure 4:
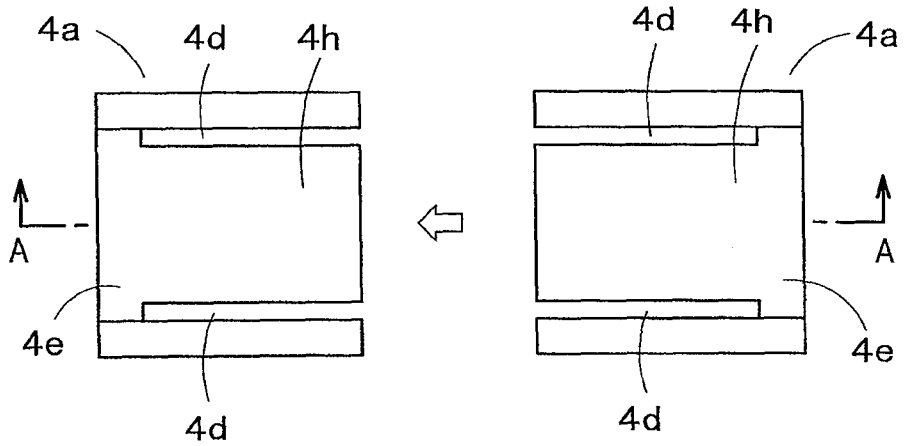
FIG. 4 is a plan view of the mounting face of the blocks which are used in the surface-mount inductor of the first embodiment according to the present invention.

As shown in FIG. 4, the mounting faces 4*e* are rectangular, with the open surface forming the short side and the other surface forming the long side. At both short sides of the mounting face 4*e*, the elongated slits 4*d* for bringing out the lead ends 2*b* therethrough are provided.

The portion of the mounting face 4*e* bordered by the slits 4*d* forms the supporting portion 4*h* which serves to support the lead ends 2*b* of the coil 2. Namely, the two slits 4*d* and the supporting portion 4*h* constitutes the U-shaped supporting structure to fit to the sectional shape of the lead ends 2*b*.

Figure 5A:
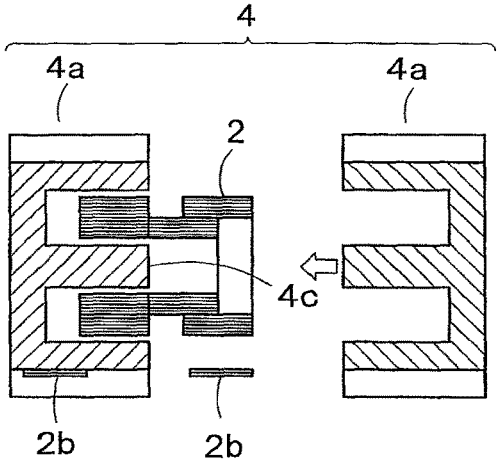
FIGS. 5A, 5B and 5C show steps for manufacturing the surface-mount inductor of the first embodiment according to the present invention, FIG. 5A showing the state before blocks being fitted, FIG. 5B showing the attached blocks, and FIG. 5C showing the state of the mounting face after fitting.
Figure 5B:
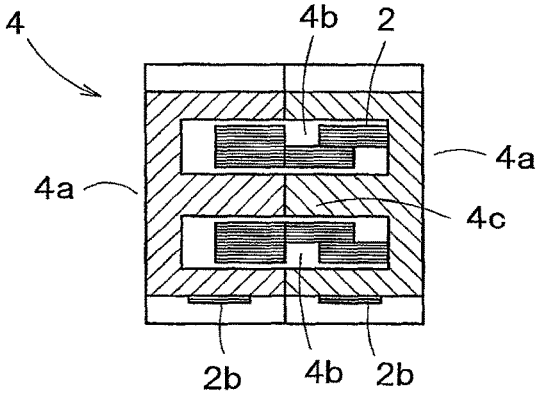
Figure 5C:
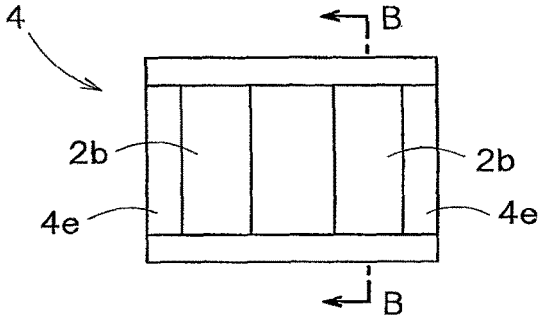

Next, the method for sealing the coil is described in reference to FIGS. 5A-5C.

FIGS. 5A and 5B are sectional views along the line A-A in FIG. 4, namely sectional views parallel with the mounting face 4*e*, while FIG. 5C is a plan view of the mounting face 4*e*.

As shown in FIG. 5A, the blocks 4*a* are arranged on both sides of the axial direction of the coil 2 in a manner that the open sides face each other. In one of the blocks 4*a*, the protrusion 4*c* of the block is inserted into the central hole of the coil 2 and the lead ends 2*b* are pulled out through the slits 4*d* of the mounting face.

FIG. 5B shows a state where other block 4*a* is fitted from the direction of the winding axis of the coil 2. The space 4*b* for accommodating the coil 2 is provided inside the block 4*a*. The coil 2 is accommodated inside the two blocks 4*a* with the protrusions 4*c* being inserted into the central hole of the coil 2. The long sides of the lead end 2*b* are brought out through the slits 4*d* so as to be parallel with the short sides of the mounting face and inserted into the other slits 4*d* to be U-shaped in section.

In this state, the two blocks 4*a* which house the coil 2 are pressed in a mold and then heated (thermocompressed). Thus, as shown in FIG. 5C, the lead ends 2*b* of the coil 2 are fixed to the mounting face 4*e* so as to be visible, and the two blocks 4*a* are solidified to form a molded body 4 sealing the coil 2 inside.

Figure 6:
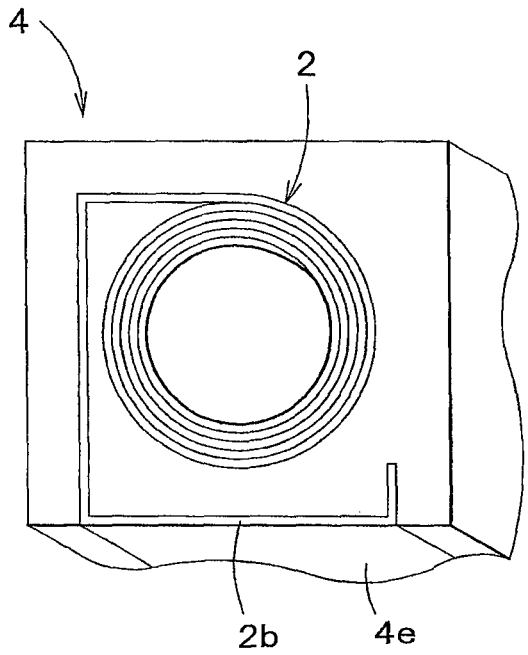
FIG. 6 is a partial perspective view showing the method of manufacturing of the surface-mount inductor of the first embodiment according to the present invention.

FIG. 6 shows the step for forming the external terminals by processing the lead ends 2*b*. FIG. 6 is the sectional view along the line B-B in FIG. 5C.

The lead ends 2*b*, which are embedded in the mounting face 4*e*, and the portion of the lead ends 2*b* exposed are machined by laser beam to remove the insulation cover therefrom. Because of the flatness of the rectangular wire, the settings for laser processing are uncomplicated. As the laser processing is used to remove the insulation off one face, the process does not require to be repeated.

The lead ends 2*b* are simultaneously sputtered with predetermined ratio of Ni and Cu to form a Ni—Cu layer, subsequently sputtering with Sn to form a Sn layer so as to process the lead ends 2*b* into the external terminals. Because of using the rectangular wire, the adhesiveness to other components may be improved, compared to the case of using a round wire. In addition, the evenness of the mounting face 4*e* can be raised.

Figure 7:
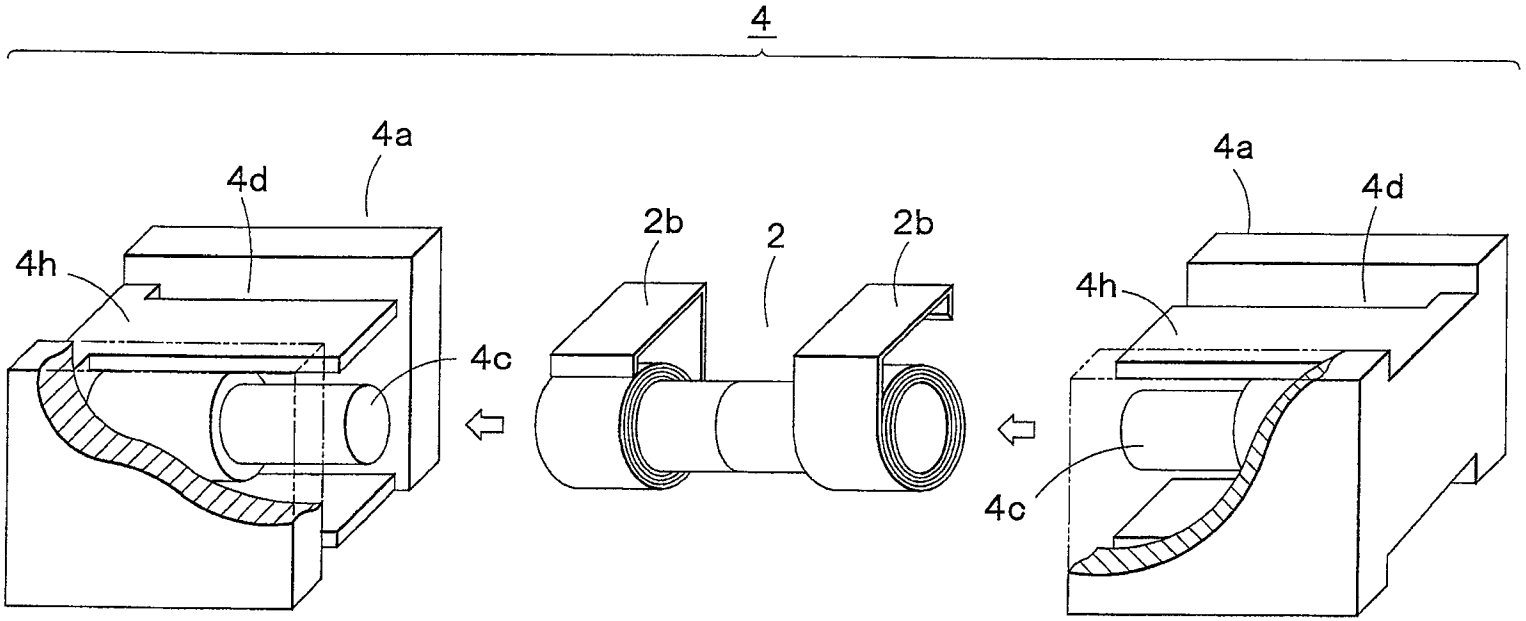
FIG. 7 shows the step for fitting the two blocks and the coil of the first embodiment according to the present invention.

FIG. 7 shows the steps for fitting the two blocks 4*a* and the coil 2 according to the first embodiment of the present invention. The left end of the coil 2 is inserted into the block 4*a* (left side in FIG. 7). For this process, the central hole of the coil 2 is positioned on the protrusion 4*c* of the block 4*a*, and the lead ends 2*b* (left side in FIG. 7) of the coil 2 are positioned to be mounted on the supporting portion 4*h* of the block 4*a*. Thus, the coil 2 is pressed toward the left as indicated by the arrow in FIG. 7 so that the coil 2 is fitted with the block 4*a* on the left in FIG. 7.

Then, the block 4*a* on the right side in FIG. 7 is fitted with the left side block 4*a* which is already fitted with the coil 2. For such a process, the central hole of the coil 2 is positioned on the protrusion 4*c* of the block 4*a* at the right side in FIG. 7, and the right-side supporting portion 4*h* is aligned with the right-side lead end 2*a*, and then the block 4*a* on the right side in FIG. 7 is pressed toward the left side as shown by the arrow. As a result, the two U-shaped portions of the lead ends 2*b* are supported by the supporting portions 4*h*.

Accordingly, the two blocks 4*a* are joined via the coil 2 so the three of them are integrated together. As described before referring to FIG. 5, the molded body 4 is formed by thermocompressing.

Since the surface-mount inductor produced as described above has an entirely symmetrical shape, the electric characteristics are the same regardless of which of the input terminals receives an input. Therefore, there is no need for marking so as to discriminate between terminals and manufacturing cost can be thus reduced.

Embodiment 2

The surface-mount inductor and the method for manufacturing the same of the second embodiment according to the present invention are described, referring to FIGS. 8-11. The same reference numbers are used in the case the components are equivalent to those of the first embodiment.

The coil and the spindle used in the second embodiment are the same as those in the first embodiment.

Figure 8:
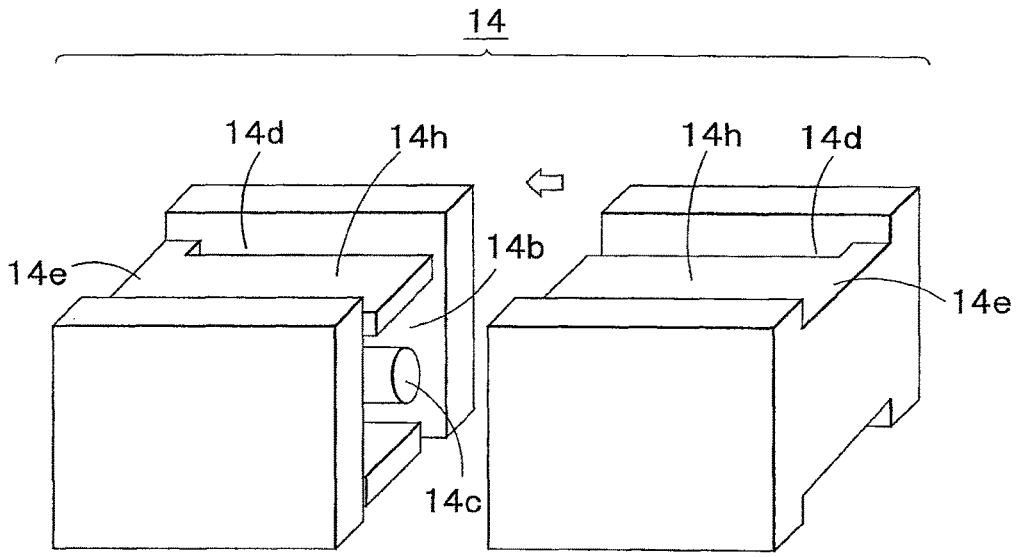
FIG. 8 is a perspective view of the blocks used in the second embodiment according to the present invention.

As shown in FIG. 8, two blocks 14*a* are assembled to make the molded body 14. The block 14*a* are formed by a sealant including metallic magnetic powder and epoxy resin. The blocks 14*a* is parallelepiped having an aperture at one end, including the space 14*b* for accommodating the coil 2 inside.

From the center of inside wall of another end surface, a cylindrical protrusion 14*c* to be inserted into the central hole of the coil 2 is provided toward the surface having the aperture. The upper and the bottom surfaces of the block 4*a* are the same in shape, anyone of the surfaces being the mounting face 14*e* (upper surface in FIG. 8).

Figure 9:
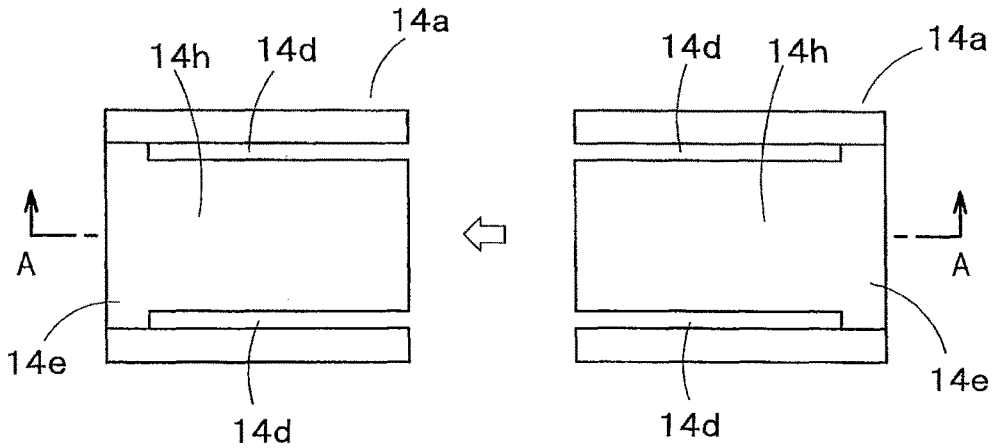
FIG. 9 is a plan view of the blocks used in the surface-mount inductor of the second embodiment according to the present invention.

As shown in FIG. 9, the outline of the mounting face 14*e* is rectangular, and the surface having the aperture is on the short side and the other surface is on the long side. The long side of the block 14*a* is larger than that of the clock 4*a* so that two coils 2 can be accommodated in the assembled two blocks 14*a*.

At the ends of the short sides of the respective mounting faces 14*e*, the elongated slits 14*d* are provided to bring out the lead ends 12*b* therethrough.

The portion between the two slits 14*d* is the supporting portion 14*h* for supporting the lead ends 2*b* of the coil 2. Namely, the two slits 14*d* and the supporting portion 14*h* form a U-shaped supporting structure in side view.

Figure 10A:
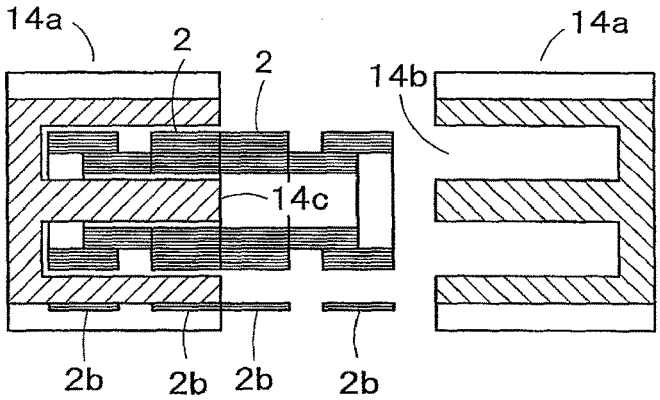
FIGS. 10A, 10B and 10C show sectional views along the line A-A in FIG. 9 for showing the method for manufacturing the second embodiment of the present invention, FIG. 10A showing the state before connecting the blocks, FIG. 10B showing the connected blocks, and FIG. 10C showing the mounting face after connecting the blocks.
Figure 10B:
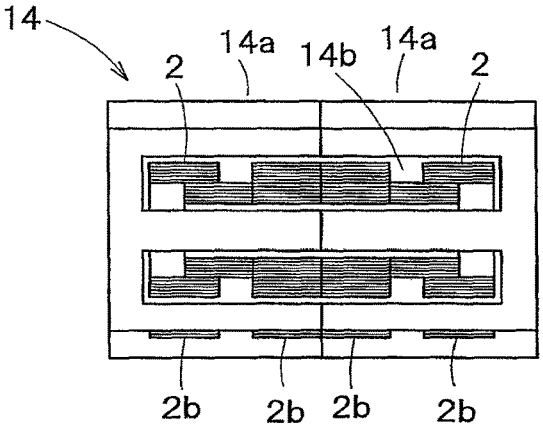
Figure 10C:
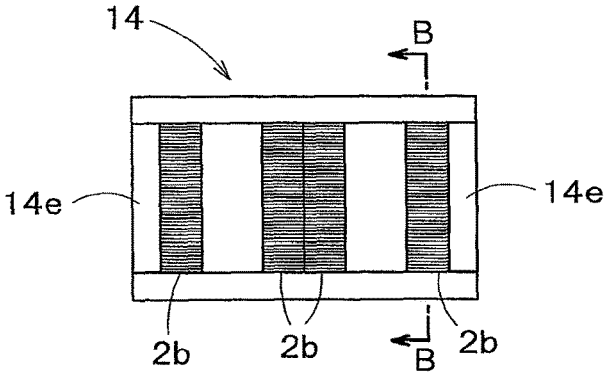

Next, the method for sealing the coil is described in reference to FIGS. 10A through 10C. FIGS. 10A, 10B are views of the section A-A in FIG. 9, namely, sectional views of a surface parallel to the mounting face 14*e* and FIG. 10C is a plan view of the mounting face 14*e*.

As shown in FIG. 10A, the two coils 2 are arranged facing each other in a manner that the first winding portions 3*a* are coaxial, and arrange the blocks 14*a* in both axial directions of the coil 2 in a manner that the open ends of the blocks 14*a* face each other. Thus, in one of the blocks 14*a*, the protrusion 14*c* of the block is inserted into the central hole of the coil 2 and the lead ends 2*b* are pulled out through the slits 14*d*. The other block 14*a* is similarly processed.

FIG. 10B shows the state of the assembled blocks 14*a*. The space 14*b* for accommodating the coil 2 is provided inside the block 14*a*. The two coils 2 are accommodated inside the blocks 4*a* in a manner that the first rolls 2*c* face each other and the protrusion 14*c* is inserted into the central hole of the coil 2.

The lead ends 2*b* are U-shaped to be suitable for being pulled out from one of the slits 14*d* parallel with the short side of the mounting face 14*e* and inserted into the other slit 14*d*.

Then, the two blocks 4*a* housing the two coils 2 are pressed in a mold and heated to be formed. Thus, as shown in FIG. 10C, the lead ends 2*b* of the coil 2 are fixed to the mounting faces 14*e* partially embedded therein to be exposed therefrom, and the two blocks 14*a*, 14*a* are pressed to harden so that a molded body 14, in which the two coils 2 are sealed, is formed. And then, the lead ends 2*b* are processed in a manner similar to that of the first embodiment so as to be external terminals.

The surface-mount inductor described above, being overall symmetrical in shape, has the same electric characteristics regardless of which of the two terminals is used for input. Therefore, it is unnecessary to mark the coil to indicate the polarity which allows for lower costs.

Embodiment 3

Figure 11:
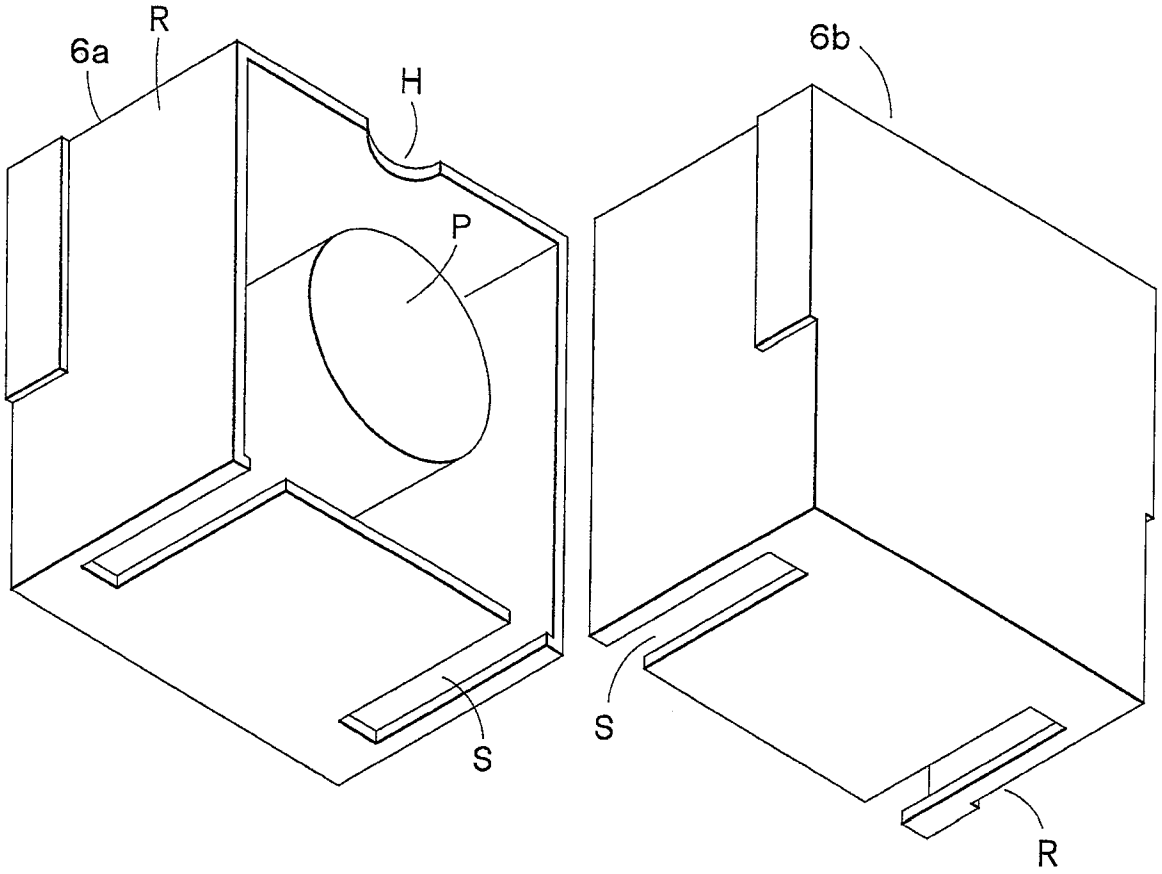
FIG. 11 is a perspective view of the magnetic cores used in the surface-mount inductor of the third embodiment according to the present invention.
Figure 12:
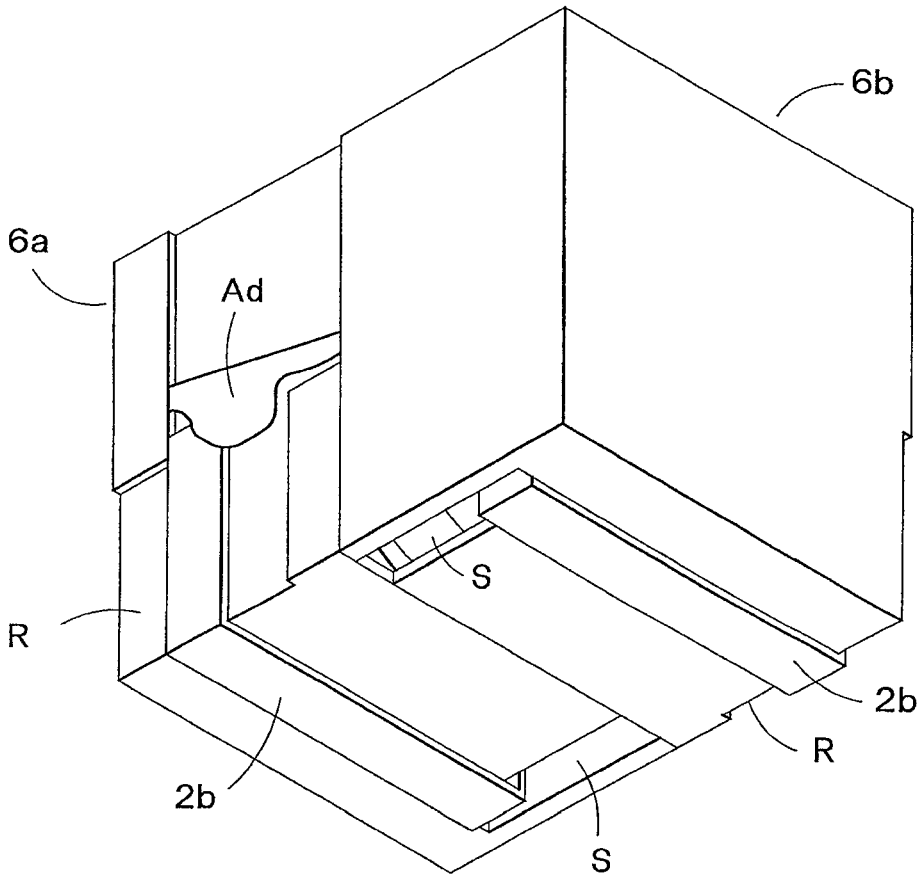
FIG. 12 is a perspective view of the surface-mount inductor of the third embodiment according to the present invention.

The surface-mount inductor and the method for manufacturing the same according to the third embodiment of the present invention are described in reference to FIGS. 11 and 12. The third embodiment is a surface-mount inductor which has a molded body housing magnetic cores and sealant.

Firstly, the coil 2 (FIG. 1) is formed in the same way as in the first embodiment. Then, a pair of bottomed magnetic cores 6*a*, 6*b*, as shown in FIG. 11, is attached to the coil 2. The magnetic cores 6*a*, 6*b* have a protrusion P to be inserted into the central hole of the coil 2, slits S to bring out the lead ends 2*b* to the mounting face, a hole H provided on the open end surface facing the mounting face, and a recess R formed in a surface adjacent to the mounting face.

The pair of bottomed cores 6*a*, 6*b* are attached by inserting the protrusion P into the central hole from both sides along the winding axis direction, and passing the lead ends 2*b* through the slits S.

Further, as shown in FIG. 11, the lead ends 2*b* of the coil 2 accommodated in the pair of bottomed magnetic cores 6*a*, 6*b* are bent along the magnetic cores 6*a*, 6*b* to extend over the mounting face of the magnetic cores 6*a*, 6*b* and over the surface adjacent to the mounting face.

The portion of the lead ends 2*b* extending over the surface adjacent to the mounting face of the magnetic cores 6*a*, 6*b* is bent upward from the mounting face of the magnetic cores 6*a*, 6*b* and arranged in the recess R formed on the surface adjacent to the mounting face of the magnetic cores 6*a*, 6*b*.

Subsequently, as shown in FIG. 12, the ends of the lead ends 2*b* of the coil 2 are adhered to the recess R formed on the surface adjacent to the mounting face of the magnetic cores 6*a*, 6*b* using an adhesive Ad.

Furthermore, the magnetic cores 6*a*, 6*b* having the coil 2 inside are placed in a mold, the mounting faces of the magnetic cores 6*a*, 6*b* being directed upward, and molding resin is poured in the mold in a manner so as to expose the mounting faces of the magnetic cores 6*a*, 6*b*.

Since the magnetic cores 6*a*, 6*b* have the slit S and the hole H, the molding resin poured inside the magnetic cores 6*a*, 6*b* suffices to fill them up to the same level of the mounting face in the slit S.

Next, after the molding resin hardens, the molded body is taken out from the mold. The molded body houses the coil 2 whose winding axis is parallel with the mounting face, with the lead ends 2*b* of the coil 2 extending over the mounting face of the magnetic cores 6*a*, 6*b* and over the surface adjacent to the mounting face, and is covered with the molding resin so as to expose the mounting face of the magnetic cores 6*a*, 6*b*. In addition, the lead ends 2*b* of the coil 2 are also covered with the molding resin.

The lead ends 2*b* of the coil 2 extending over the mounting face 4*e* of the molded body 4, which consists of the mounting faces of the magnetic cores 6*a*, 6*b*, are used as external terminals, the insulation coating being removed. Electrodes covering the portions of lead ends 2*b*, which are extending over the mounting face 4*e* of the molded body 4, are provided in order to form the external terminals.

Although the surface-mount inductor and the method for manufacturing the same have been described in relation to the embodiments, the present invention should not be limited thereto. A part of the blocks may be replaced with a magnetic core, and a part of the magnetic cores may be replaced with a block. The mounting face of the magnetic cores may be covered with the molding resin in a manner that the surface of the lead ends 2*b* is exposed. In addition, the molding resin may include ferrite powder.

The molded body 4, 14 may be equipped with a pair of metal bodies. The pair of metal bodies are so formed to cover the upper and end surfaces and the adjacent surfaces of the molded body, the lower ends of the metal bodies reaching the same level of the external terminals formed on the mounting faces 4*e*, 14*e* of the mounting bodies 4, 14.

When mounting and soldering the surface-mount inductor described above on a wiring board, the gaps between the metal bodies and the external terminals may be filled with solder fillet so as to firmly secure the surface-mount inductor to the board securely. In addition, external noise can be shut out.

Further, in the second embodiment, the mounting face of the magnetic cores may be covered with the molding resin to expose the surface of the magnetic cores.

EXPLANATION OF CODES

1 surface-mount inductor
2 coil
2*a* wide surface
2*b* lead end

2*c* first roll
2*d* second roll
2*e* third roll
3 spindle
3*a* winding core
3*aa* tip
3*b* base portion
3*c* jig
4, 14 molded body
4*a*, 14*a* block
4*b*, 14*b* space
4*c*, 14*c* protrusion
4*d*, 14*d* slit
4*e*, 14*e* mounting face
5 external terminal
6*a*, 6*b* magnetic core
P protrusion
S slit
H hole
R recess
Ad adhesive

What is claimed is:

1. A method for manufacturing a surface-mount inductor including a coil formed by winding a rectangular wire and a molded body for accommodating the coil, comprising:

a step for making a coil, forming a first roll contacting the median portion of a rectangular wire to the spindle of a winding machine to wind, forming a second winding portion at a position adjacent to the first roll along the winding axis, arranging a jig at the first roll side of the second roll, forming a third roll winding the wire on the second roll at a position opposite to the first roll along the winding axis in such a manner that a portion of the third roll partially overlaps with the second roll, and forming lead ends brought out from the outermost turns of the first roll and of the third roll; and a step for housing the coil inside the molded body, whereby the coil is housed in the molded body, arranging the winding axis to be parallel with the mounting face of the molded body and the lead ends to extend over the surface of the molded body.

2. The method for manufacturing the surface-mount inductor according to claim 1, wherein the molded body symmetrically houses two of the coils.

3. The method for manufacturing the surface-mount inductor according to claim 1, wherein two of the coils are arranged in the molded body in such a manner that the coils face each other.

* * * * *